US006981477B2

(12) United States Patent
Uozaki et al.

(10) Patent No.: US 6,981,477 B2
(45) Date of Patent: Jan. 3, 2006

(54) VALVE TIMING CONTROL DEVICE

(75) Inventors: Mitsuru Uozaki, Obu (JP); Shigeru Nakajima, Anjo (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 46 days.

(21) Appl. No.: 11/062,475

(22) Filed: Feb. 22, 2005

(65) Prior Publication Data

US 2005/0183682 A1 Aug. 25, 2005

(30) Foreign Application Priority Data

Feb. 25, 2004 (JP) ..... 2004-050498

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS

2003/0005900 A1 * 1/2003 Katayama et al. ..... 123/90.17

FOREIGN PATENT DOCUMENTS

| | | |
|---|---|---|
| JP | 3365199 | 3/1996 |
| JP | 2000-282821 | 3/1999 |
| JP | 2002-276312 | 3/2001 |

* cited by examiner

*Primary Examiner*—Thomas Denion
*Assistant Examiner*—Zelalem Eshete
(74) *Attorney, Agent, or Firm*—Reed Smith LLP; Stanley P. Fisher, Esq.; Juan Carlos A. Marquez, Esq.

(57) ABSTRACT

A valve timing control device comprises a drive side rotation member for rotating with a crank shaft with synchronization, a driven side rotation member arranged coaxially with the drive side rotation member and slidable therewith, the driven side rotation member rotating with the camshaft, and a rotation phase position adjustment mechanism for adjusting a relative rotation phase between the drive side rotation member and the driven side rotation member by an operating oil. The drive side rotation member and the driven side rotation member form a vertical sliding surface relative to a rotation axis, and an oil reservoir is formed at the driven side rotation member. The oil reservoir is open to the sliding surface and is connected to a drain for the operating oil.

10 Claims, 4 Drawing Sheets

VALVE TIMING CONTROL DEVICE

CROSS REFERENCE TO RELATED APPLICATIONS

This application is based on and claims priority under 35 U.S.C. §119 with respect to a Japanese Patent Application 2004-050498, filed on Feb. 25, 2004, the entire content of which is incorporated herein by reference.

FIELD OF THE INVENTION

This invention relates to a valve timing control device for an internal combustion engine installed in a vehicle. More particularly, the invention relates to a valve opening and closing timing control device for optimizing the opening and closing timings of an intake or discharge valve in response to driving conditions of the internal combustion engine.

BACKGROUND

A valve timing control device is known which controls valve opening and closing timings in response to the drive condition of the internal combustion engine. For example, a control device disclosed in Japanese Patent Publication No. 3365199 includes a timing pulley having a partition wall defining plural hydraulic chambers in the inner periphery thereof, a rotation member having a vane dividing the hydraulic chamber into a hydraulic operating chamber for rotating a cam shaft toward an advance angle direction relative to the timing pulley and a hydraulic operating chamber for rotating the cam shaft toward a retard angle direction relative to the timing pulley, a hydraulic passage for supplying or discharging an operating oil to each hydraulic operating chamber in communication therewith, an oil pressure adjusting means for controlling the supply and discharge of the operating oil to and from each passage and a phase maintaining mechanism for maintaining the phase difference between the timing pulley and the rotation member.

Further, as other related art, a Japanese Patent Publication 2000-282821 A discloses a valve timing control device which includes a groove shaped oil film maintaining means between an axial end surface of mutually sliding rotation members and an end surface of a plate member which supports the rotation member to solve the problem of insufficient oil film on the sliding surface.

Further, as other related art, a Japanese Patent Publication 2002-276312 A discloses a valve timing control device which includes a torsion spring for biasing the rotation member in an advance angle direction to both decrease the volume of the retard angle chamber and to increase the volume of the advance angle chamber by assisting the operation of the vanes.

The first related art, Japanese Patent Publication No. 3365199 discloses an oil supply structure for supplying a very small amount of operating oil exuded from the vane operating oil filled hydraulic chamber onto the sliding surface of the sliding member. This structure, however, is not an active supply system for supplying positively the operating oil onto the sliding surface. This structure may lead to oil film shortage on the sliding surface and, further, friction between the sliding surfaces may increase if foreign matter or abrasion powder penetrates the sliding surfaces. Such impediments may adversely affect the operational responsiveness of the vanes (vane operation delays), and abrasion of the friction members may be accelerated.

According to the valve timing control device disclosed in the second related art, Japanese Patent Publication 2000-282821 A, the operating oil is liquid-tightly sealed in the groove by the oil film maintaining means, and gradually sludge, or foreign matter, is accumulated at the oil film maintaining means, thus eventually resulting in a deterioration in the level of lubrication performance.

According to the valve timing control device disclosed in the third related art, Japanese Patent Publication 2002-276312 A, the operational responsiveness of the vane can be enhanced when the vane is advanced against the reaction force from the cam mechanism. This is because the torsion spring assists the vane operation in an advance direction. However, the contact resistance between the torsion spring and the rotation member is too large, and leads to unstable vane operation, and the switching of vanes may not be smoothly performed. Further, the sliding member is worn out earlier due to the contact resistance between the torsion spring and the rotation member.

Accordingly, this invention pertains to a stable supply of operating oil, while avoiding shortages of oil film on the sliding surface. Further, the invention pertains to improvements in supply of operating oil to sliding surfaces at vanes, advanced or retarded. A need accordingly exists for a valve timing control device with an improved performance in which operating oil can be stably supplied to sliding members.

SUMMARY OF THE INVENTION

According to one aspect of the invention, the valve timing control device includes a drive side rotation member for rotating with a crank shaft with synchronization, a driven side rotation member arranged coaxially with the drive side rotation member and slidable therewith, the driven side rotation member rotating with the camshaft, and a rotation phase position adjustment mechanism for adjusting a relative rotation phase between the drive side rotation member and the driven side rotation member by an operating oil, wherein a vertical sliding surface relative to a rotation axis is formed by the drive side rotation member and the driven side rotation member, and an oil reservoir is formed at the driven side rotation member, the oil reservoir being open to the sliding surface and being in communication with a drain for the operating oil.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
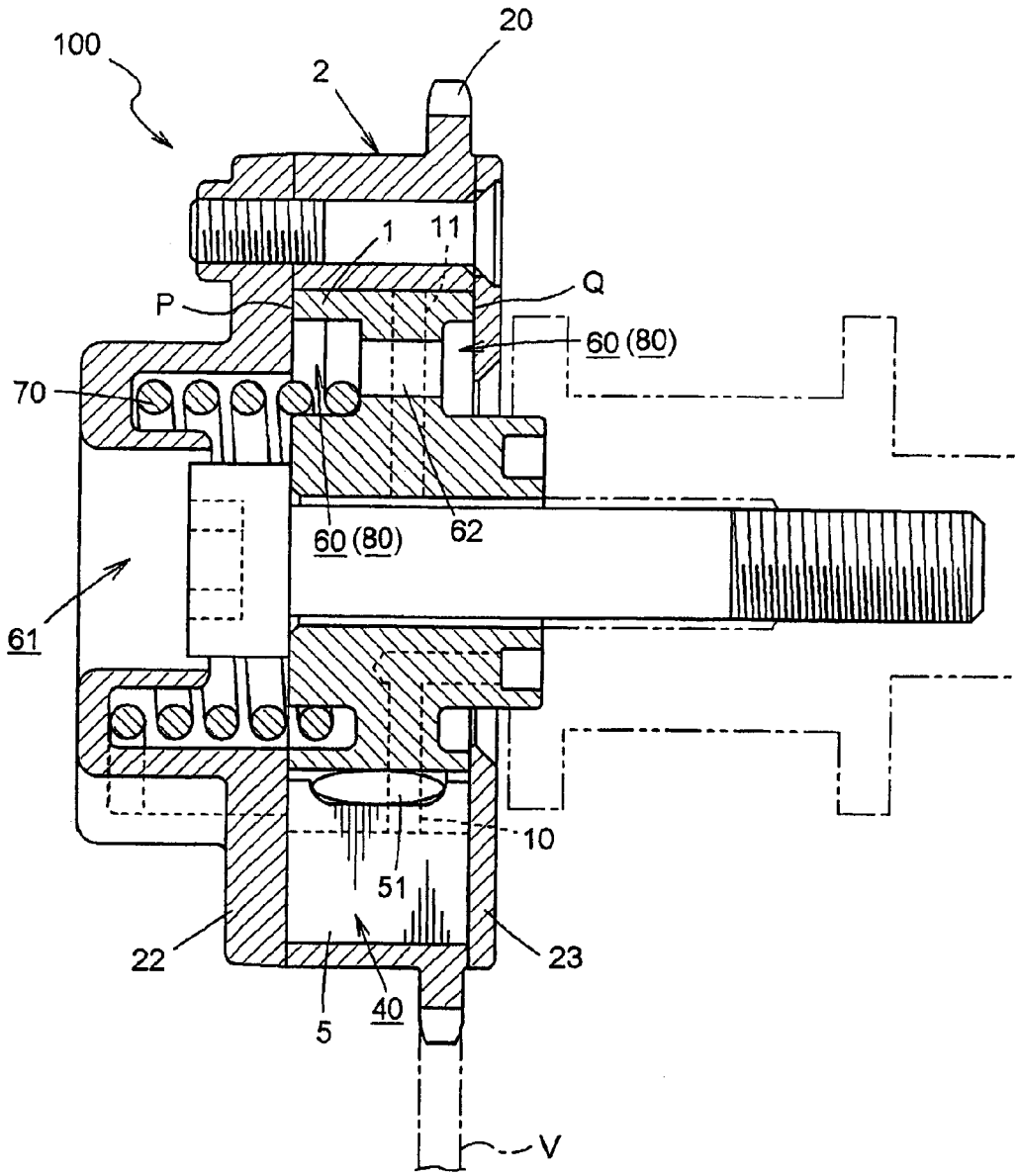
FIG. 1 is a cross sectional view of a valve timing control device 100 according to the present invention.

The valve timing control device 100 includes a rotational phase adjustment mechanism that adjusts a relative rotation phase between the exterior rotor 2 and the interior rotor 1 by means of operation oil from a hydraulic passage, the exterior rotor 2 serving as a drive side rotation member for synchronized rotation with the crankshaft of the vehicle engine, etc., and the interior rotor serving as a driven side rotation member, positioned co-axially with the exterior rotor, slidable with the exterior rotor and rotating with the camshaft.

The interior rotor is joined integrally with the end portion of the camshaft so as to rotate as a unit with a camshaft that has been positioned so as to be capable of rotating with the cylinder head of the engine.

The exterior rotor 2 includes a timing sprocket 20 trimmed so to be capable of rotating relatively, within a determined range of the relative rotation phase, relative to the interior rotor 1, and is positioned integrally on the outer periphery of the front plate 22, the rear plate 23 and the exterior rotor 2. Because the exterior rotor 2 does not rotate relatively between the front plate 22 and the rear plate 23, in the context of this application, it is treated integrally with the exterior rotor 2 and the front plate 22, unless specifically indicated to the contrary.

Moreover, a power-transmitting member such as a timing chain or a timing belt V is provided between the timing sprocket 20 and the gear installed in the crankshaft of the engine.

Figure 2:
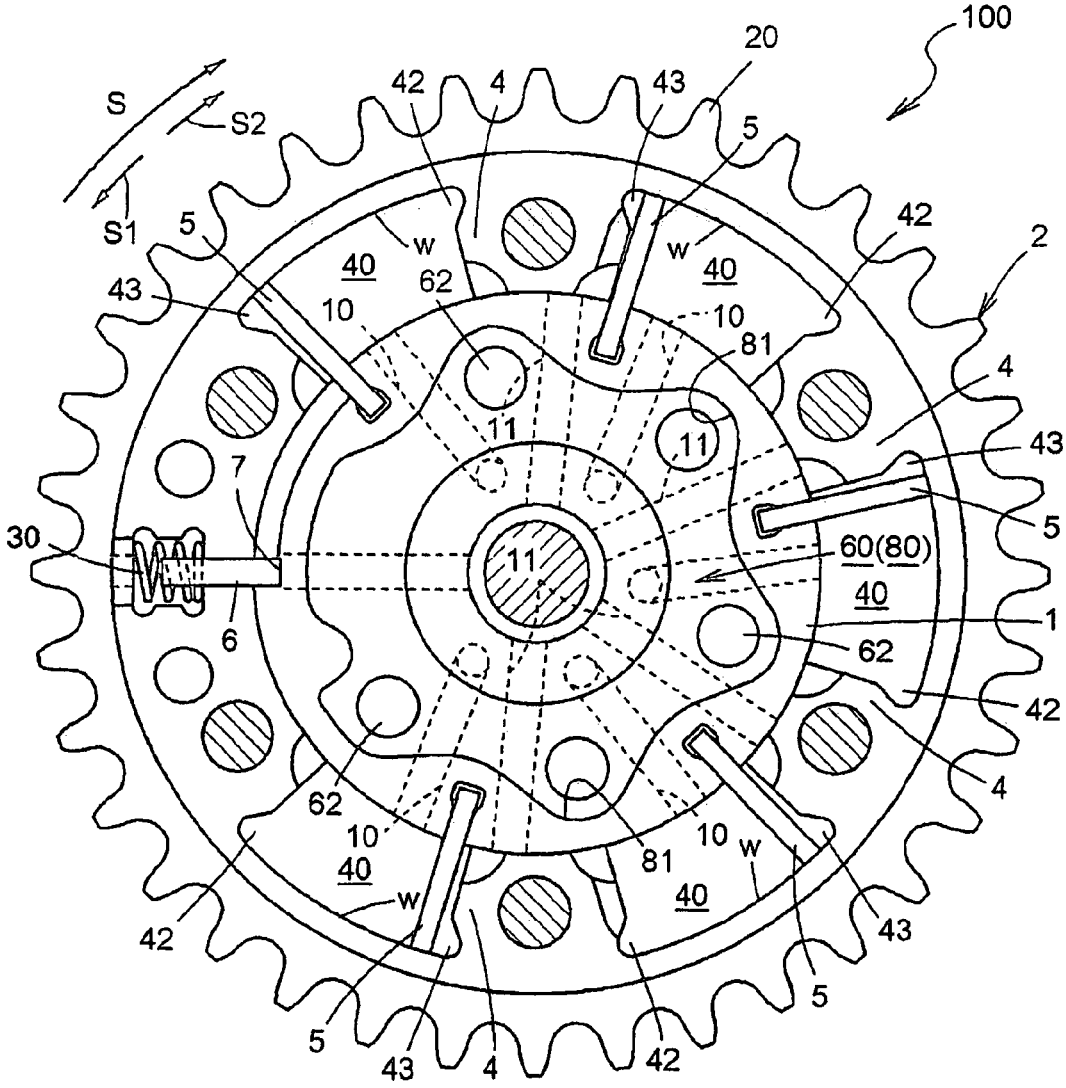
FIG. 2 is a front view of the valve timing control device 100 showing the inner part thereof at a most retarded position.

When the crankshaft of the engine is rotably driven, because the rotational drive is transmitted to the timing sprocket 20 by means of the power-transmitting member, the exterior rotor on which the timing sprocket is provided is, as is illustrated in FIG. 2, rotably driven in a rotational direction, the interior rotor 1 is accordingly driven along the rotational direction S, the camshaft rotates, and the can mechanism, positioned in the engine, pushes down the intake valve, or the exhaust valve, of the engine, and thereby opens the valve.

Rotational Phase Adjustment Mechanism.

Figure 3:
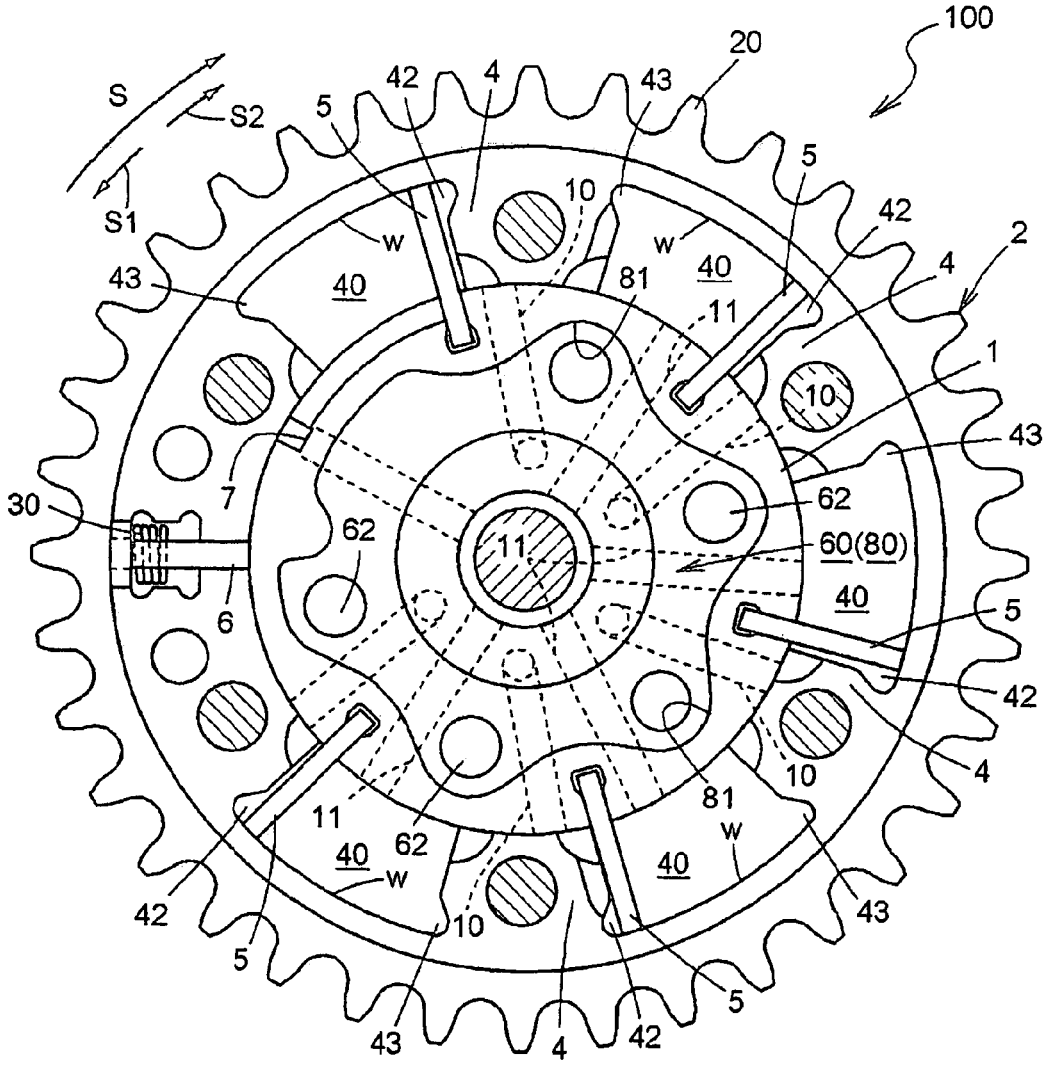
FIG. 3 is a front view of the valve timing control device 100 showing the inner part thereof at a most advanced position.

As is illustrated in FIGS. 2 and 3, plural projections 4 serving as shoes that protrude in an inner diametrical direction are provided in rows at intervals from one another in a rotational direction. Moreover, in the gaps between each of the projections that adjoin the exterior rotor 2 a hydraulic pressure chamber 40, defined by the exterior rotor 2 and the interior rotor 1, is formed.

On an outer peripheral portion of the interior rotor 2 vane grooves are formed at a number of positions facing the respective hydraulic pressure chambers 40. In these vane grooves 41, vanes 5, which split a hydraulic pressure chamber 40 in a relative rotational direction (as indicated by arrows in an S1 direction and an S2 direction in FIGS. 2 and 3 respectively), into an advance angle chamber and a retard angle chamber, are slidably inserted along a radial direction. By means of a spring provided on an inner diameter the vanes 5 are biased against a surface of an inner wall within the hydraulic pressure chamber.

The advance angle chamber 43 is connected to an advance angle passage 11 formed on the interior rotor 1, and the retard angle chamber 42 is likewise connected to a retard angle passage 10 formed on the interior rotor 1. The advance angle passage 11 and the retard angle passage 10 are both connected to an oil pressure passage that is not indicated in the drawings. When the operation oil is supplied from the hydraulic passage to the advance angle chamber 43 of the hydraulic pressure 40 through the advance angle passage 11, by means of hydraulic pressure the vanes 5 move in a retard angle direction (a condition illustrated in FIG. 3). On the other hand, when operation oil is supplied to the retard angle chamber 42 of the hydraulic pressure chamber 40 through the retard angle passage 10, by means of hydraulic pressure the vanes 5 move in a retard angle direction (a condition illustrated in FIG. 2). Because a rotational phase of the interior rotor 1 is modified by means of the vanes 5, a timing at which the cam mechanism of the camshaft, directly connected to the interior rotor 1, pushes down the intake valve, or the exhaust valve, is thereby changed.

Rotational Phase Restricting Mechanism

At a time when a rotational phase relative between an interior rotor 1 and an exterior rotor 2 is in a determined lock phase established within the retard angle phase, a rotational phase restricting mechanism is constructed, made up of a lock member 6 and a locking groove 7, for restricting relative rotation between the interior rotor 1 and the exterior rotor 2. The lock member 6 is a plate-shaped member attached to the exterior rotor 2, and is balanced against the interior rotor 1 by means of a spring 30. Locking grooves 7 are elongated grooves that can accommodate locking member 6 positioned at the interior rotor 1. In circumstances where the interior rotor 1 and the exterior rotor 2 are in a positional relationship expressed as a determined lock phase, lock grooves 7 engage with lock member 6, and are able to restrict relative rotation between the exterior rotor 2 and the interior rotor 1.

Further, the valve timing control device of the present invention, as shown in FIG. 2, illustrates circumstances in which it is at its most retard angle, and this condition corresponds to the determined lock phase mentioned above. Further, the valve timing control device illustrated in FIG. 3 indicates circumstances where it is at a most advance angle, and in this state relative rotation is possible in a retard angle (S1) direction relative between the exterior rotor 2 and the interior rotor 1.

Oil Reservoir

Figure 4:
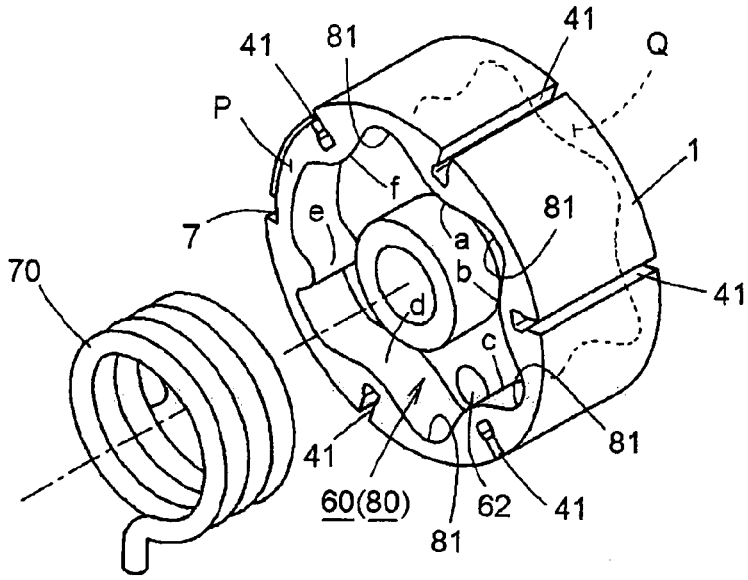
FIG. 4 is a perspective view of the inner rotor provided at the oil reservoir formed as a star pattern hollowed portion with a recess portion.

In the valve timing control device of the present invention a vertical sliding surface P is formed on a rotational axis by the exterior rotor 2 and the interior rotor 1, and an oil reservoir 60 is formed on the interior rotor 1, an oil reservoir that has an opening opposite to the sliding surface P and is connected to a drain of the operation oil. This may be a hole portion that is capable of holding operation oil formed by drilling a hole in the interior rotor 1, but, for example, as shown in FIG. 2 or FIG. 3, it can also be a star pattern hollowed portion 80 that has a recess portion 81 formed diametrically outwards in at least one of the portions positioned between the vanes 5, a portion that adjoins the interior of each of various vanes 5 positioned at the interior rotor 1. FIG. 4 is a perspective view of an interior rotor 1 on which an oil reservoir 60 is positioned, an oil reservoir 60 constructed as a star pattern hollowed portion 80 with a recess portion 81. The star pattern hollowed portion 80 may be formed by cutting the solid interior rotor 1, or equally it may be formed by a process of casting with the use of a die. In the case of an interior rotor 1 constructed as an oil reservoir 60, when the engine rotates, operation oil, which gushes from the hydraulic pressure chamber 40 to a boundary portion extending between the interior rotor 1 and the exterior rotor 2, can be stored and preserved by means of centrifugal force in a recess portion 81, and, when the engine is not operating, it is possible to discharge the operation oil from the star pattern hollowed portion to the drain of an outer portion.

Below is a detailed description of an operation of the valve timing control device 100, a description focused on the vicinity of the oil reservoir.

When the engine is operated, and rotation of the interior rotor 1 and the exterior rotor 2 of the valve timing control device 100 begins, operation oil is supplied to the hydraulic pressure chamber 40 from either the advance angle passage 11 or the retard angle passage 10. At this time, because the supply pressure of the operation supplied to the hydraulic pressure chamber 40 is set so as to be greater than the centrifugal force created by rotation, the operation oil inside the hydraulic pressure chamber 40 gradually oozes out from the boundary portion extending between the exterior rotor 2 and the interior rotor 1. Moreover, as a result of the centrifugal force of rotation created by the rotation of the interior rotor 1, the operation oil that has oozed out is retained in the recess portions 81 of the star pattern hollowed portion 80 of the interior rotor 1. Once operation oil is retained in the recess portions 81 during the process of rotation, by virtue of the effects of centrifugal force the operation oil continues to remain supported within the recess portion 80. Thus, the star pattern hollowed portion 80 that serves as the oil reservoir 60 opens opposite the sliding surface P and is configured so that the sliding surface P becomes one of the side surfaces. For this reason it is possible to use the operation oil supported by the recess portion 81 of the star pattern hollowed portion 80 to lubricate positively the sliding surface P that adjoins recess portion 81.

When, in the above manner, the oil reservoir 60 of the inner rotor 1 is a star pattern hollowed portion 80, operation oil at a time of relative rotation of the interior rotor 1, in other words, at a time of an advance angle, or of a retard angle, of vanes 5, can be supplied speedily, and with a degree of certainty, to the sliding surface P; it also becomes possible to lubricate substantially the entirety of the sliding surface; and it also becomes possible to prevent breakdowns and other kinds of trouble caused by the loss of oil film. Moreover, because sludge and the like cannot accumulate within the oil reservoir 60, maintenance of the valve control device 100 becomes simple, and it becomes possible to keep in check the occurrence of breakdowns.

On the other hand, when the engine stops, because the star pattern hollowed portion 80 is connected to a drain of the outer portion, it is possible to discharge easily the operation oil from the star pattern hollowed portion 80. In other words, when rotation of the interior rotor 1 and the exterior rotor 2 come to a stop, because the centrifugal force created by rotation is nullified, the operation oil supported by the recess portion 81 of the star pattern hollowed portion 80 goes into a free fall, and is discharged towards the drain from the gap 61 on the side of the drain which is connected to the drain (not shown in the Drawings). It is recognized that operation oil does remain in the interior rotor 1, but the operation oil that does remain is promptly supplied to the sliding surface P on the next occasion that the engine is put into operation. Because the valve timing control device 100 can in this manner easily extract the operation oil from the drain whenever the engine comes to a stop, it becomes possible to eliminate easily any foreign matter that might have infiltrated.

Moreover, by virtue of forming on the interior rotor 1, as in this invention, an oil reservoir 60 constituted as a star pattern hollowed portion 80, the valve timing control device 100 can be made lighter, and because it is possible to reduce the level of inertia in the rotation member, it becomes possible to control, as and when appropriate, timings at which the valve is opened and closed. The device is also effective in terms of reducing the level of expenditure on fuel required by the engine. Furthermore, by positioning the recess portions of the star pattern hollowed portion 80 in the proximity of the hydraulic pressure chamber 40, the distance moved by the operation oil, which has gushed out from the boundary portion extending between the exterior rotor 2 and the interior rotor 1, is abbreviated, and it is advantageous that the operation oil can promptly enter the star pattern hollowed portion 80.

Nonetheless, in the gap between the interior rotor 1 and the exterior rotor 2, in addition to the sliding surface P described above, there is also a vertical sliding surface Q on a rotational axis on the rear side (the camshaft side). As can be seen from FIG. 2, in the case of an interior rotor that has two sliding surfaces, P and Q, that is, on both sides in a rotational axis direction, it is also possible to position oil reservoirs 60 on both sides, oil reservoirs that open onto the sliding surfaces and that are also connected with the drain of the operation oil. An explanation of the advantages of such an arrangement will follow.

The valve timing control device 100 is surrounded by the interior rotor 1 and the exterior rotor 2. In more particular detail, the interior rotor 1 is of a so-called sandwich configuration according to which it is sandwiched between a front plate 22 and a rear plate 23. In this configuration, the interior rotor may on occasions deviate towards the side of one or the other of the sliding surface P and the sliding surface Q. In such an eventuality, a difference is generated between the state of lubrication of the two sliding surfaces P and Q, and this situation can lead to problems such as abrasion. Accordingly, when oil reservoir 60 with openings on both the sliding surface P and the sliding surface Q is provided on both sides in a rotational axis direction of the interior rotor 1, because in these circumstances operation oil can be supplied to both of the sliding surfaces P and Q with a degree of certainty, lubrication on both surfaces can be maintained, and it is also possible to prevent damage to the interior rotor 1, such as uneven wear.

Further, if through holes 62 are provided on the oil reservoirs 60, and it accordingly becomes possible for operation oil to move freely between the two sliding surfaces P and Q, it is possible to ensure that an amount of operation oil appropriate to the circumstances of rotation is automatically provided to both of the sliding surfaces P and Q.

Further Embodiments (1) In the present invention the internal rotor 1 and the exterior rotor 2 can, for example, be manufactured by sintering of metal powder. If the sintering method is employed, because it is easy to form, by a process of molding, oil reservoirs of a shape that are symmetrical about both sides of the interior rotor 1, it is possible to curb any increase in manufacturing costs.

Figure 5:
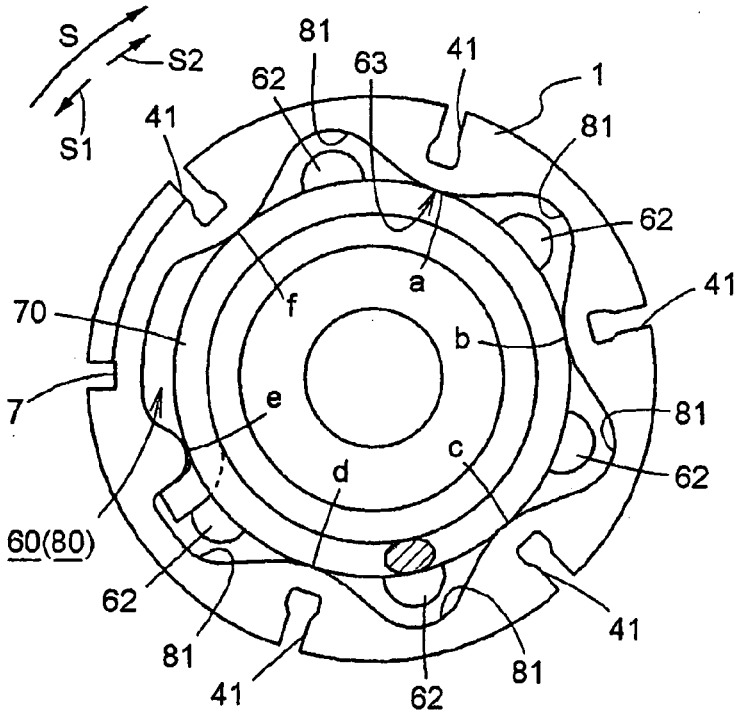

(2) As illustrated in FIGS. 4 and 5, for purposes of complementing the actions of the vanes 5 it is also possible to provide a torsion spring 70 on the valve timing control device. One end of a torsion spring 70 is fixed to a front plate 22, and the other end to the interior rotor 1. As a result, the torsion spring biases the interior rotor 1 in the S2 direction, as illustrated in FIG. 5, so that vanes 5 proceed in an advance direction. Further, the torsion spring is supported at the innermost diameter portion of the oil reservoir 60 by what is substantially point contact. In FIG. 5, the torsion spring 70 is substantially in point contact with six different points in the innermost diameter portion, positions a, b, c, d, e and f, as illustrated in FIG. 5, and is thus supported.

By virtue of this process of point contact with the innermost diameter portion 63, the torsion spring 70 can be positioned in an appropriate diametrical direction within the interior rotor 1. Further, this kind of point contact results in a diminution, to a considerably small size, in the area of contact between the torque spring 70 and the interior rotor 1, friction loss is accordingly reduced to a low level, and it becomes possible to transmit an appropriate degree of torque constantly. Because, in this manner, by means of the torsion spring 70 the complementary operations of the vanes 5 are made stable, it becomes possible to achieve changes in valve timings that are both accurate and speedy.

According to one aspect of the invention, the valve timing control device includes a drive side rotation member for rotating with a crank shaft with synchronization, a driven side rotation member arranged coaxially with the drive side rotation member and slidable therewith, the driven side rotation member rotating with the camshaft, and a rotation phase position adjustment mechanism for adjusting a relative rotation phase between the drive side rotation member and the driven side rotation member by an operating oil, wherein a vertical sliding surface relative to a rotation axis is formed by the drive side rotation member and the driven side rotation member, and an oil reservoir is formed at the driven side rotation member, the oil reservoir being open to the sliding surface and being in communication with a drain for the operating oil.

In this structure, since the oil reservoir is provided at the driven side rotation member open to the vertical sliding surface relative to the rotation axis of the drive side and driven side rotation members, the sliding surface is expected to be supplied with operating oil in the oil reservoir for uniform lubrication. The operating oil can be supplied sufficiently onto the sliding surface at relative rotation of the driven side rotation member (vane advance or retard angle operation) to prevent defects caused by the insufficient lubrication. Further, the operating oil is drained and discharged when the operation of the valve timing control device is stopped to discharge any remaining foreign objects.

According to another aspect of the invention, the valve timing control device includes two sliding surfaces positioned at both sides of the driven side rotation member in a rotational axis direction, and the oil reservoir is open to the two sliding surfaces.

In this structure, even if the driven side rotation member deviates at one side in an axial direction, the lubrication on the sliding surfaces at both sides of the driven side rotation member in a rotational axis direction can be smoothly performed to prevent abnormal abrasion resulting from such deviation.

According to a further aspect of the invention, the valve timing control device includes a through hole in the oil reservoir. In this structure, the operating oil can move between the two sliding surfaces via the through hole to supply an appropriate amount of oil automatically to the two sliding surfaces in response to the rotational condition of the device.

In this structure, it is also possible to provide the oil reservoir by recessing a portion of the driven side rotation member from its rotation center in a radial direction. Since the oil reservoir has recess portion formed by recessing the portion of the driven side rotation member in a radial direction from rotation center of thereof, the operating oil can be easily supplied at the reservoir by a centrifugal force when in rotation and quickly the oil is discharged to the drain when the rotation is stopped. This can prevent sludge and other external objects from accumulating in the reservoir. Thus maintenance of the valve timing control device can be easily achieved, and any undesired failures prevented.

According to another aspect of the invention, the through hole is provided at the recess portion of the driven side rotation member.

In this structure, the operating oil can be easily supplied at the recess portion and is easily filled by the centrifugal force. The operating oil is movable between the two sliding surfaces via the through hole.

According to another aspect of the invention, a torsion spring is provided in the valve timing control device, a torsion spring that biases the driven side rotation member towards the drive side rotation member and is in contact with the innermost diameter portion of the oil reservoir. In this structure, since the torsion spring is in point contact with the innermost diameter portion, the radial position of the torsion spring is determined within the driven side rotation member, and the contact area between the torsion spring and the driven side rotation member can be minimized to reduce the friction loss. This structure can also produce an accurate torque transmission.

According to a further aspect of the invention, the through hole is open when the torsion spring is projected to the through hole in an axial direction. In this structure, the operating oil can move between the two sliding surfaces via the opening even if the torsion spring is positioned at the reservoir. This can achieve an automatic supply of the appropriate amount of oil to the two sliding surfaces in accordance with the rotation condition of the valve timing control device.

According to a still further aspect of the invention, a vane is provided for dividing the hydraulic pressure chamber, positioned between the driven and drive side rotation members, into an advance angle chamber and a retard angle chamber. The recess portion can be provided between the neighboring vanes. In this structure, since the vanes are provided in the recess portion, the radial length of the device can be shortened and the strength of support by vanes can be improved.

According to another aspect of the invention, one end of the torsion spring is engaged with the recess portion. In this structure, an extra member for supporting the torsion spring is unnecessary and the overall structure can be minimized.

According to a further aspect of the invention, sintering with metal powder is used to form the driven side rotation member. This can facilitate the forming of the oil reservoir by molding at both sides of the driven side rotation member symmetrically.

What is claimed is:

1. A valve timing control device comprising a drive side rotation member for rotating with a crank shaft with synchronization, a driven side rotation member arranged coaxially with the drive side rotation member and slidable therewith, the driven side rotation member rotating with the cam shaft, and a rotation phase position adjustment mechanism for adjusting a relative rotation phase between the drive side rotation member and the driven side rotation member by an operating oil, wherein a vertical sliding surface relative to a rotation axis is formed by the drive side rotation member and the driven side rotation member, and an oil reservoir is formed at the driven side rotation member, the oil reservoir being open to the sliding surface and being connected to a drain for the operating oil.

2. The valve timing control device according to claim 1, wherein the sliding surface is two sliding surfaces positioned at both sides of the driven side rotation member in a rotationalaxis, and the oil reservoir is open to the two sliding surfaces.

3. The valve timing control device according to claim 2, wherein a through hole is provided in the oil reservoir.

4. The valve timing control device according to claim 3, wherein the oil reservoir has recess portion formed by recessing a portion of the driven side rotation member in a radial direction from a rotation center thereof.

5. The valve timing control device according to claim 4, wherein the through hole is provided at the recess portion.

6. The valve timing control device according to claim 4 further including a torsion spring for biasing the driven side rotation member against the drive side rotation member so as to be in contact with an innermost diameter portion of the oil reservoir.

7. The valve timing control device according to claim 6, wherein the through hole is open when the torsion spring is projected on the through hole in an axial direction.

8. The valve timing control device according, to claim 4, wherein a vane is provided at the driven side rotation member for dividing a hydraulic pressure chamber, provided between the driven side rotation member and the drive side rotation member, into an advanced chamber and a retard chamber, and wherein the recess portion is arranged between neighboring vanes.

9. The valve timing control device according to claim 7, wherein an end of the torsion spring is engaged with the recess portion.

10. The valve timing control device according to claim 4, wherein the driven side rotation member is formed by sintering.

* * * * *